US011459208B2

(12) United States Patent
Hallikainen et al.

(10) Patent No.: US 11,459,208 B2
(45) Date of Patent: Oct. 4, 2022

(54) ELEVATOR SAFETY GEAR TRIGGER AND RESET SYSTEM

(71) Applicant: Kone Corporation, Helsinki (FI)

(72) Inventors: Pekka Hallikainen, Helsinki (FI); Antti I Maki, Helsinki (FI); Antti Koskinen, Helsinki (FI); Petri Hartikainen, Helsinki (FI)

(73) Assignee: Kone Corporation, Helsinki (FI)

( * ) Notice: Subject to any disclaimer, the term of this patent is extended or adjusted under 35 U.S.C. 154(b) by 364 days.

(21) Appl. No.: 16/693,790

(22) Filed: Nov. 25, 2019

(65) Prior Publication Data

US 2020/0198932 A1 Jun. 25, 2020

(30) Foreign Application Priority Data

Dec. 20, 2018 (EP) ..... 18214646

(51) Int. Cl.
*B66B 5/26* (2006.01)
*B66B 5/04* (2006.01)
*B66B 7/04* (2006.01)

(52) U.S. Cl.
CPC ..... *B66B 5/26* (2013.01); *B66B 5/04* (2013.01); *B66B 7/044* (2013.01)

(58) Field of Classification Search
CPC .... B66B 5/26; B66B 5/22; B66B 5/18; B66B 5/16; B66B 5/04; B66B 7/044
See application file for complete search history.

(56) References Cited

U.S. PATENT DOCUMENTS 5,366,044 A * 11/1994 Jamieson ..... B66B 5/16 187/359
8,939,262 B2 * 1/2015 Schienda ..... B66B 5/06 187/287
9,457,990 B2 * 10/2016 Osmanbasic ..... B66B 5/20
2004/0178023 A1 * 9/2004 Maury ..... B66B 5/04 187/373

(Continued)

FOREIGN PATENT DOCUMENTS

DE 202017103555 U1 7/2017
EP 2558396 A1 2/2013

OTHER PUBLICATIONS

Extended European Search Report for European Application No. 18214646.4 dated Jul. 1, 2019.

*Primary Examiner* — Michael A Riegelman
(74) *Attorney, Agent, or Firm* — Harness, Dickey & Pierce, P.L.C.

(57) ABSTRACT

The system comprises a synchronization shaft rotatably supported on an elevator car frame, the synchronization shaft being operatively connected to at least one safety gear, a lever attached to the synchronization shaft, an electromagnet operatively connected to the lever, spring means operatively connected to the synchronization shaft, and resetting means operatively connected to the synchronization shaft. Deactivation of the electromagnet releases the lever allowing the spring means to rotate the synchronization shaft from a first position to a second position in which the safety gear is activated. Activation of the resetting means rotates the synchronization shaft from the second position to the first position in which the safety gear is deactivated and the spring means is brought back to the excited state at the same time.

15 Claims, 11 Drawing Sheets

(56) References Cited

U.S. PATENT DOCUMENTS

Figure 1:
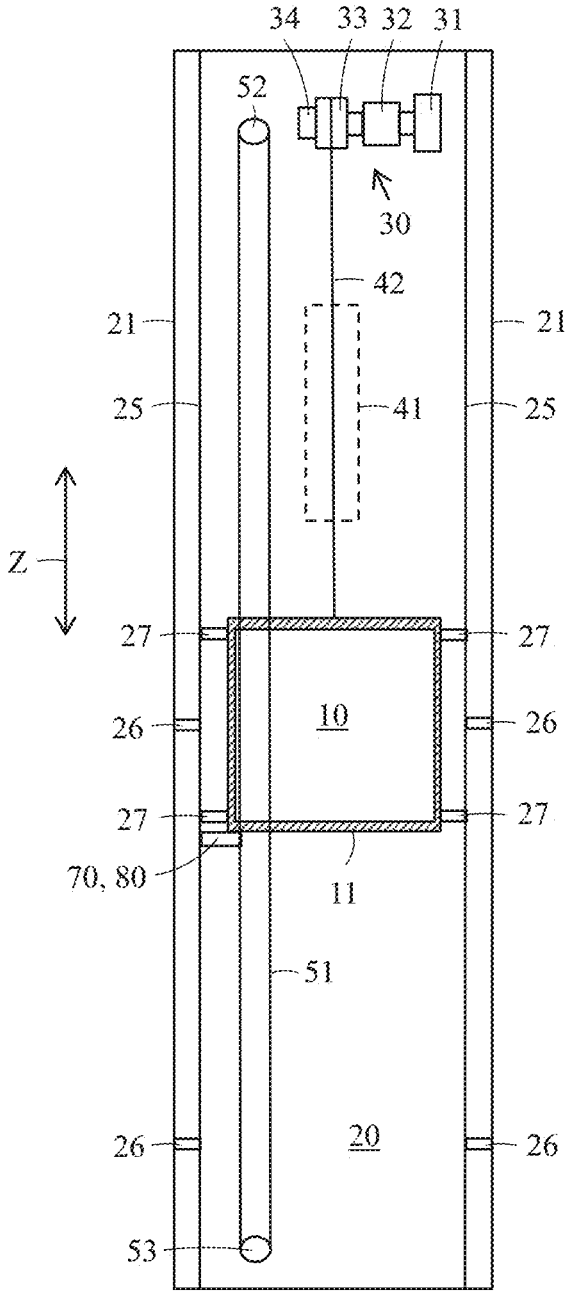

| | | | | |
|---|---|---|---|---|
| 2015/0225207 | A1* | 8/2015 | Minatta | B66B 5/005 187/377 |
| 2016/0272464 | A1* | 9/2016 | Hugel | B66B 5/18 |
| 2017/0073191 | A1* | 3/2017 | Thumm | B66B 5/18 |
| 2017/0355563 | A1* | 12/2017 | Zimmerli | B66B 7/044 |
| 2018/0186603 | A1* | 7/2018 | Virta | B66B 5/16 |
| 2020/0198932 | A1* | 6/2020 | Hallikainen | B66B 5/04 |
| 2021/0371244 | A1* | 12/2021 | Strother | B66B 5/0031 |

* cited by examiner

ELEVATOR SAFETY GEAR TRIGGER AND RESET SYSTEM

RELATED APPLICATIONS

This application claims priority to European Patent Application No. EP18214646.4 filed on Dec. 20, 2018, the entire contents of which are incorporated herein by reference.

FIELD

The invention relates to an elevator safety gear trigger and reset system.

BACKGROUND

An elevator may typically comprise a car, an elevator shaft, hoisting machinery, ropes, and a counterweight. A car frame may surround and support the car or the car frame may form an integral part of the car. The hoisting machinery may be positioned in the shaft and may comprise a drive, an electric motor, a traction sheave, and a machinery brake. The hoisting machinery may move the car in a vertical direction upwards and downwards in the vertically extending elevator shaft. The ropes may connect the car frame and thereby also the car via the traction sheave to the counterweight. The car frame may further be supported with gliding means on guide rails extending along the height of the shaft. The guide rails may be supported with fastening brackets on the side wall structures of the shaft. The gliding means may engage with the guide rails and keep the car in position in the horizontal plane when the car moves upwards and downwards in the elevator shaft. The counterweight may be supported in a corresponding way on guide rails supported on the wall structure of the shaft. The elevator car may transport people and/or goods between the landings in the building. The elevator shaft may be formed so that the wall structure is formed of solid walls or so that the wall structure is formed of an open steel structure.

Safety regulations require that elevators are provided with equipment for monitoring the speed of the elevator car in order to stop the elevator car if a predetermined maximum speed is exceeded or the elevator car starts moving without being commanded to when standing on a landing. An overspeed situation may arise e.g. if the hoisting ropes of the elevator car start slipping due to insufficient friction between the ropes and the traction sheave, the hoisting ropes break, the control system goes berserk or if the traction sheave shaft breaks and the elevator car starts falling freely in the elevator shaft. The equipment monitoring the speed may comprise at least a speed limiter monitoring the speed of the elevator car to ensure that the maximum speed will not be exceeded and a safety gear mechanism. The safety gear mechanism may be formed of one or more safety gears connected to the speed limiter and attached to the elevator car or the car frame. The speed limiter activates the safety gear mechanism to stop the elevator car in the event of overspeed. The safety gears may be connected through a linkage system to the speed limiter.

Prior art elevator speed limiters are often based on mechanical pulley and rope systems, comprising a speed limiter pulley positioned e.g. in the upper part of the elevator shaft, a tensioning pulley positioned in the lower part of the elevator shaft and a speed limiter rope fitted to run in a substantially tight closed loop around these pulleys. The safety gears may be connected via a linkage system to the speed limiter rope, which, when the elevator car is moving, runs around the speed limiter pulley and the tensioning pulley. If the elevator car and thereby also the speed limiter rope move at an excessive speed, then the rotation of the speed limiter pulley is stopped by a mechanism activated e.g. by centrifugal force. This means that also the speed limiter rope stops moving and exerts thereby a pull on the linkage system arranged in connection with the elevator car that is still moving. The linkage system thereby activates the safety gears in order to stop the elevator car.

In so-called high-rise or mega-high-rise elevators, for reasons of design dimensioning, two safety gear pairs may be used instead of one. Both safety gear pairs may be connected to the same speed limiter rope. The safety gear pairs may be arranged to grip the guide rails simultaneously or one pair after the other with a delay.

Speed limiter ropes are typically steel ropes. In high-rise elevators the weight and inertia of these ropes become challenging for the design of the speed limiter mechanism.

EP 2 558 396 discloses an actuator for a braking device and an elevator installation. The electrically tripped actuator comprises a casing provided with a tripping spring, a holding device, a resetting device, an actuation lever, and a guide lever. The actuation lever and the guide lever are rotatably supported via a common fulcrum in the casing. A first connection point of the actuation lever at a first side of the fulcrum is operatively connected to a first brake and a second connection point of the actuation lever at a second opposite side of the fulcrum is operatively connected to a second brake. The holding device holds the tripping spring, the first connection point and the second connection point in a first operating position in which the brakes are deactivated. The tripping spring is connected to a third connection point on the actuation lever positioned between the first connection point and the second connection point. The holding device comprises a catch pivotably attached to the guide lever and an electromagnet operatively connected to the catch. Activation of the electromagnet rotates the catch around the pivot point so that the catch grips a fourth connection point of the actuation lever connecting the actuation lever to the guide lever. Deactivation of the electromagnet in an overspeed situation results in that the fourth connection point of the actuation lever is released from the catch enabling rotation of the actuation lever around the fulcrum forced by the tripping spring so that the brakes are activated. Resetting of the actuator is done with the resetting device by rotating the guide lever around the fulcrum towards the actuation lever, whereby activation of the electromagnet connects the catch again to the fourth connection point of the actuation lever. The guide lever and the actuation lever connected with the catch to the guide lever are then rotated back with the resetting device around the fulcrum to the first operating position, whereby the tripping spring becomes excited and the brakes become deactivated.

SUMMARY

An object of the present invention is an improved elevator safety gear trigger and reset system.

The elevator safety gear trigger and reset system according to the invention is defined in claim 1.

The elevator safety gear trigger and reset system comprises:

a synchronization shaft rotatably supported on an elevator car frame, the synchronization shaft being operatively connected to at least one safety gear, a lever attached to the synchronization shaft, an electromagnet operatively connected to the lever, spring means operatively connected to the synchronization shaft, resetting means operatively connected to the synchronization shaft, whereby activation of the safety gear is achieved by deactivating the electromagnet so that the lever is released from the operative connection with the electromagnet allowing the spring means to rotate the synchronization shaft from a first position in which the safety gear is deactivated to a second position in which the safety gear is activated, and deactivation of the safety gear and resetting of the safety gear trigger is achieved by activating the resetting means to rotate the synchronization shaft from the second position in which the safety gear is activated to the first position in which the safety gear is deactivated, the spring means being brought back to the excited state at the same time.

The inventive safety gear trigger and reset system eliminates the speed limiter rope, the pulleys associated with the speed limiter rope and the linkage system connecting the speed limiter rope to the safety gears used in prior art safety gear systems.

Any kind of speed detector may be used in connection with the inventive safety gear trigger and reset system. The speed detector may be based on electronical devices e.g. it may be based on one or more acceleration sensors or it may be based on encoder data. The encoder may be used to measure the rotation speed of the electric motor driving the traction sheave. The speed detector may on the other hand be based on mechanical devices e.g. a roller acting on the car guide rail.

The inventive safety gear trigger and reset system may be used in connection with any kind of safety gear. The safety gear may be provided only in connection with one guide rail or in connection with both guide rails or there may be more than one safety gear on each guide rail.

The inventive safety gear trigger and reset system may be used in connection with any kind of elevators. The safety gear trigger and reset system is especially suitable to be used in high-rise or mega-high rise buildings in which the elimination of a speed limiter rope running over pulleys in the upper and in the lower portion of the shaft is a big advantage.

The inventive safety gear trigger and reset system may advantageously be used in modernisations of elevators. The speed limiter rope, the pulleys associated with the speed limiter rope and the linkage system connecting the speed limiter rope to the safety gears may be removed from an existing elevator and replaced with the inventive safety gear trigger and reset system. The lever may be connected to an existing synchronization shaft in the elevator. An existing speed detector and an existing control unit in the elevator may be used to control the inventive safety gear trigger.

The inventive safety gear trigger and reset system may be fitted in a limited space in connection with the pair of beams forming a horizontal top beam and/or in connection with the pair of beams forming a horizontal bottom beam of a car frame in an existing elevator.

DRAWINGS

Figure 2:
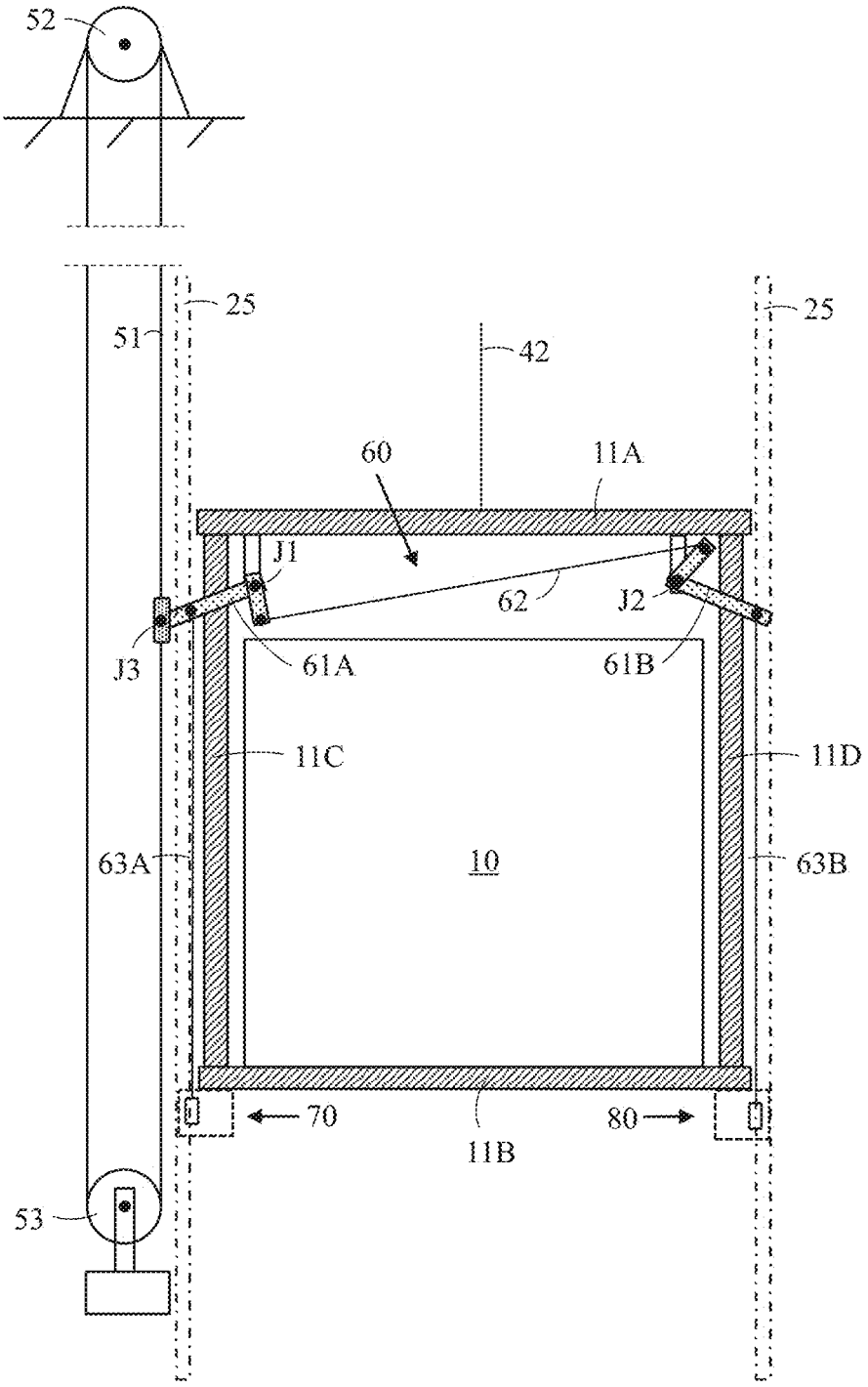
FIG. 2 (Prior art)
Figure 3:
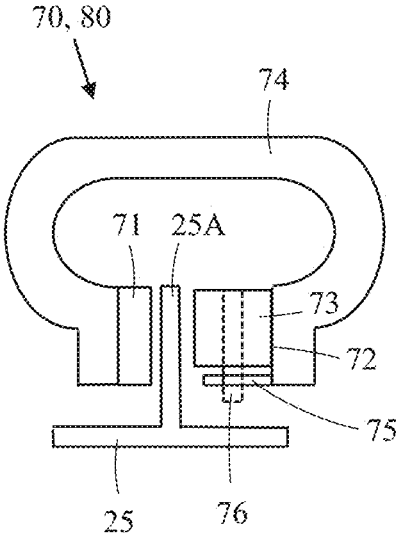
Figure 4:
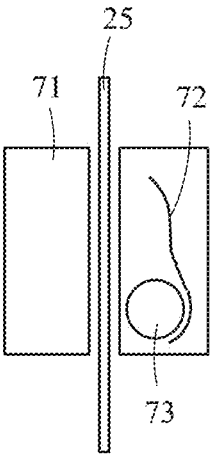
Figure 5:
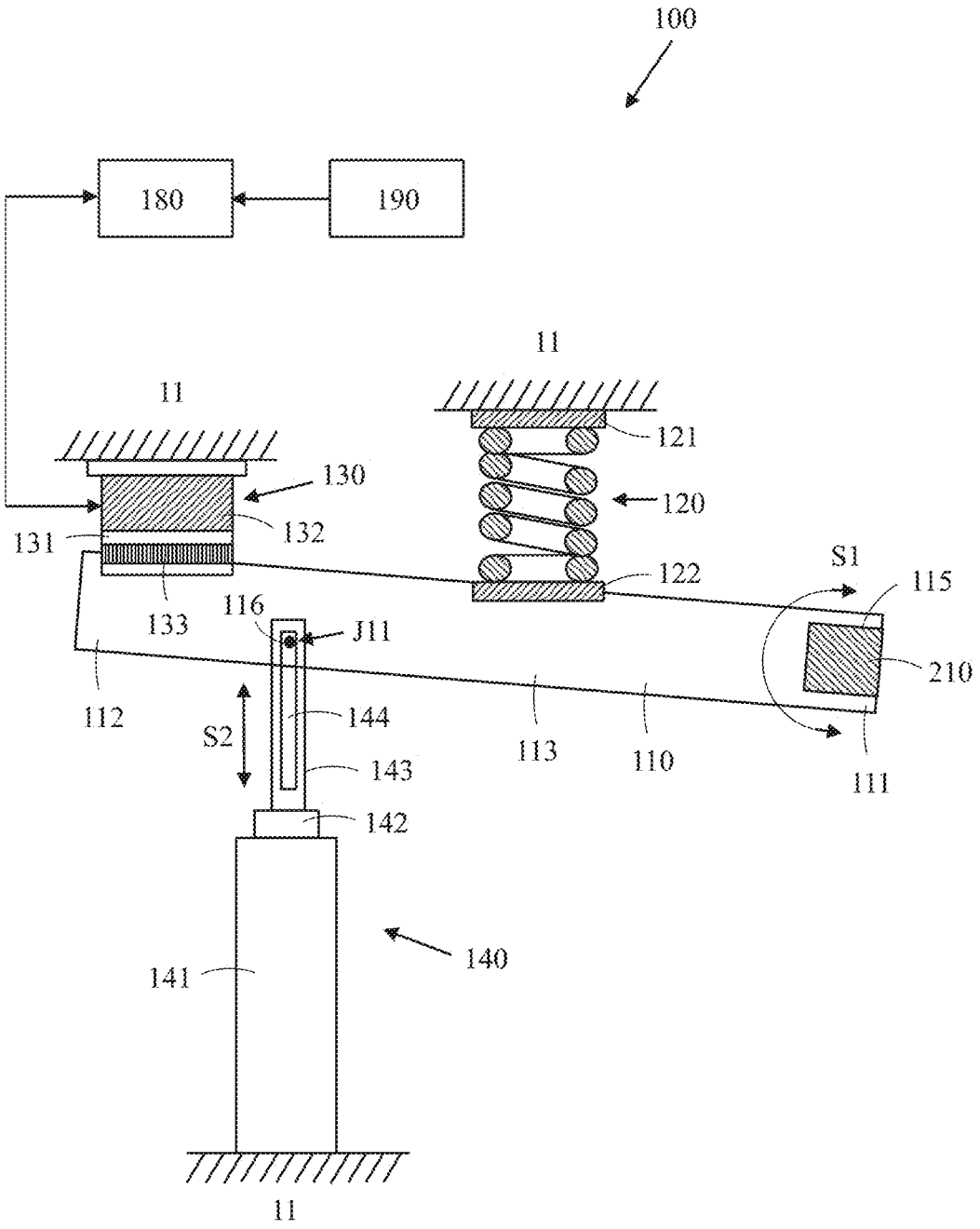
Figure 6:
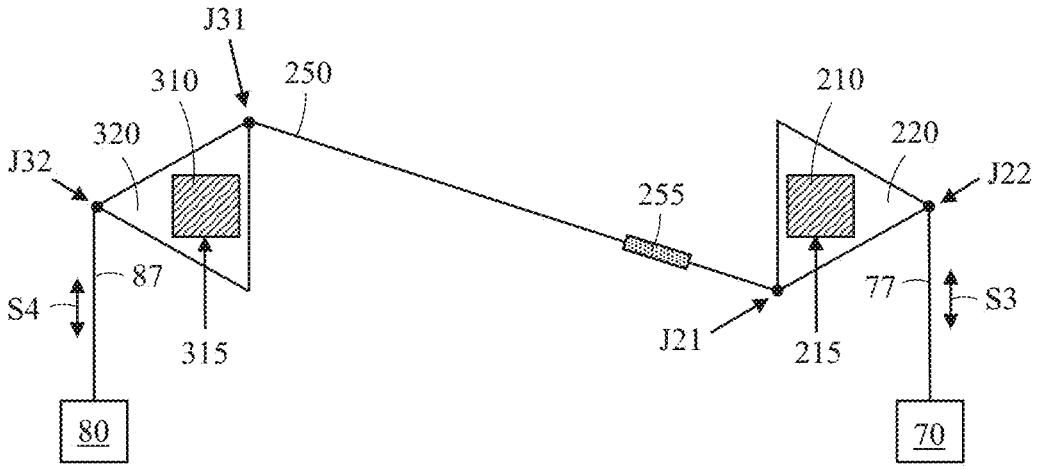
Figure 7:
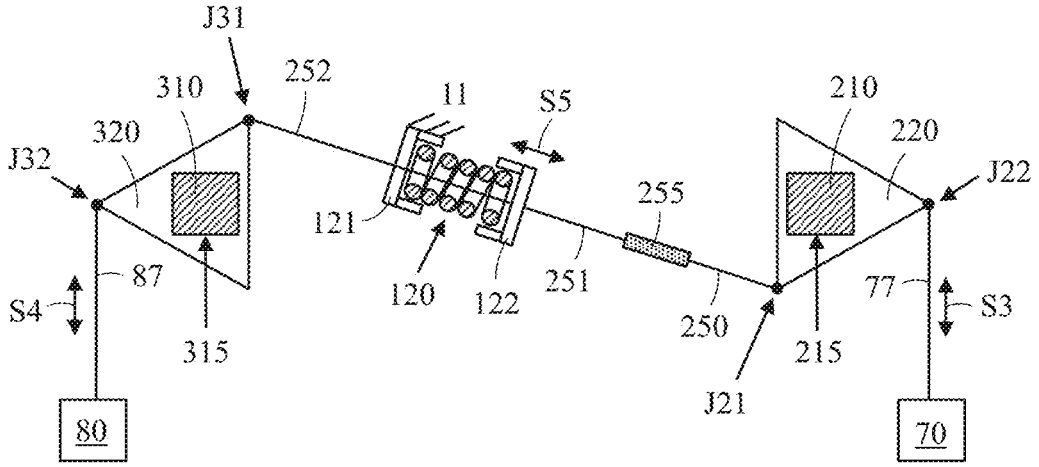
Figure 8:
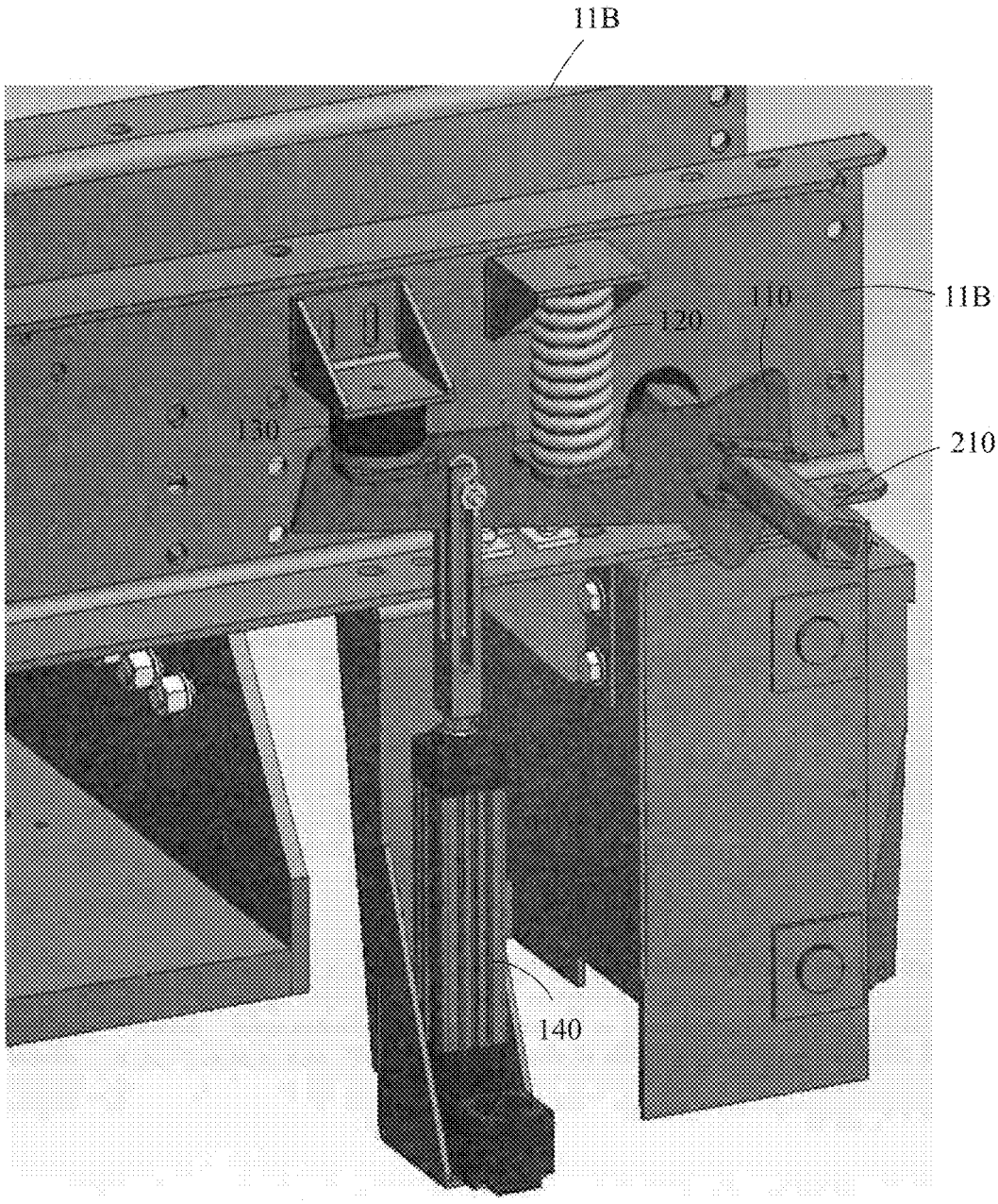
Figure 9:
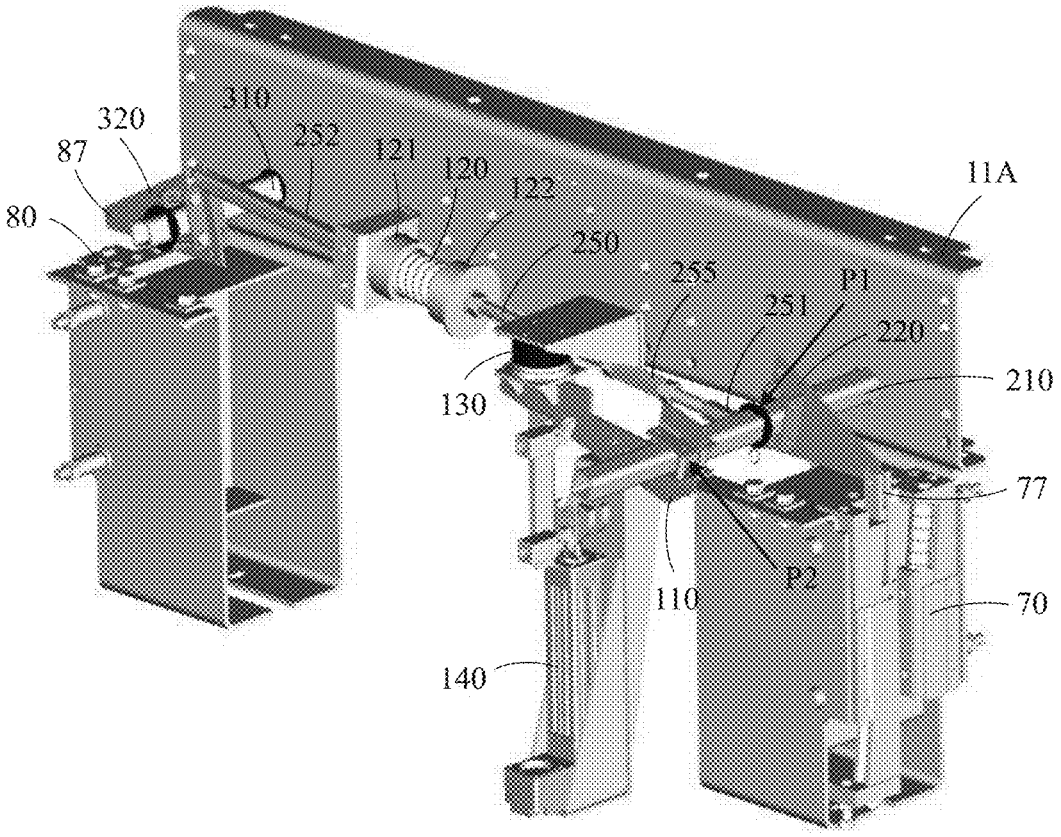
Figure 10:
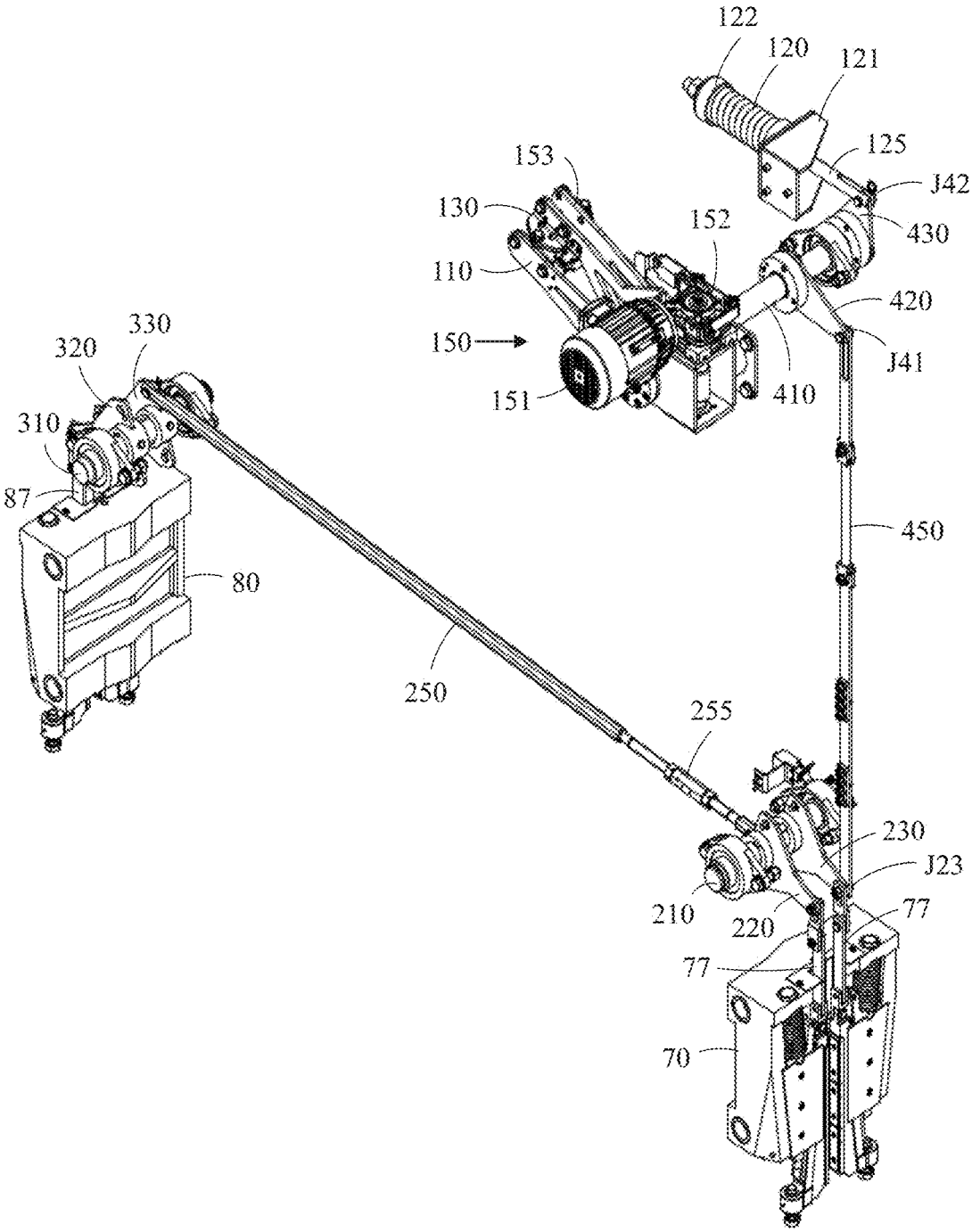
Figure 11:
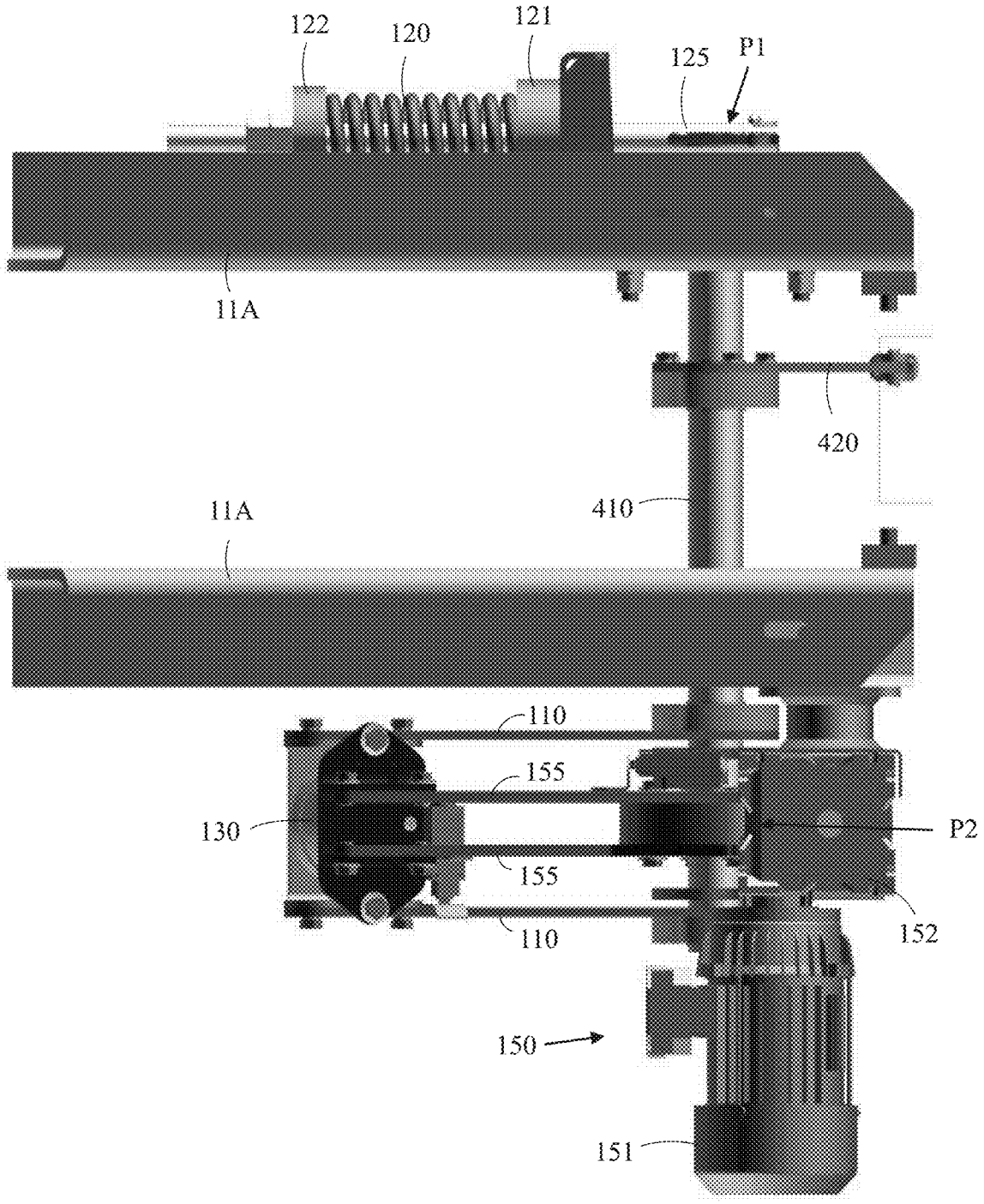
Figure 12:
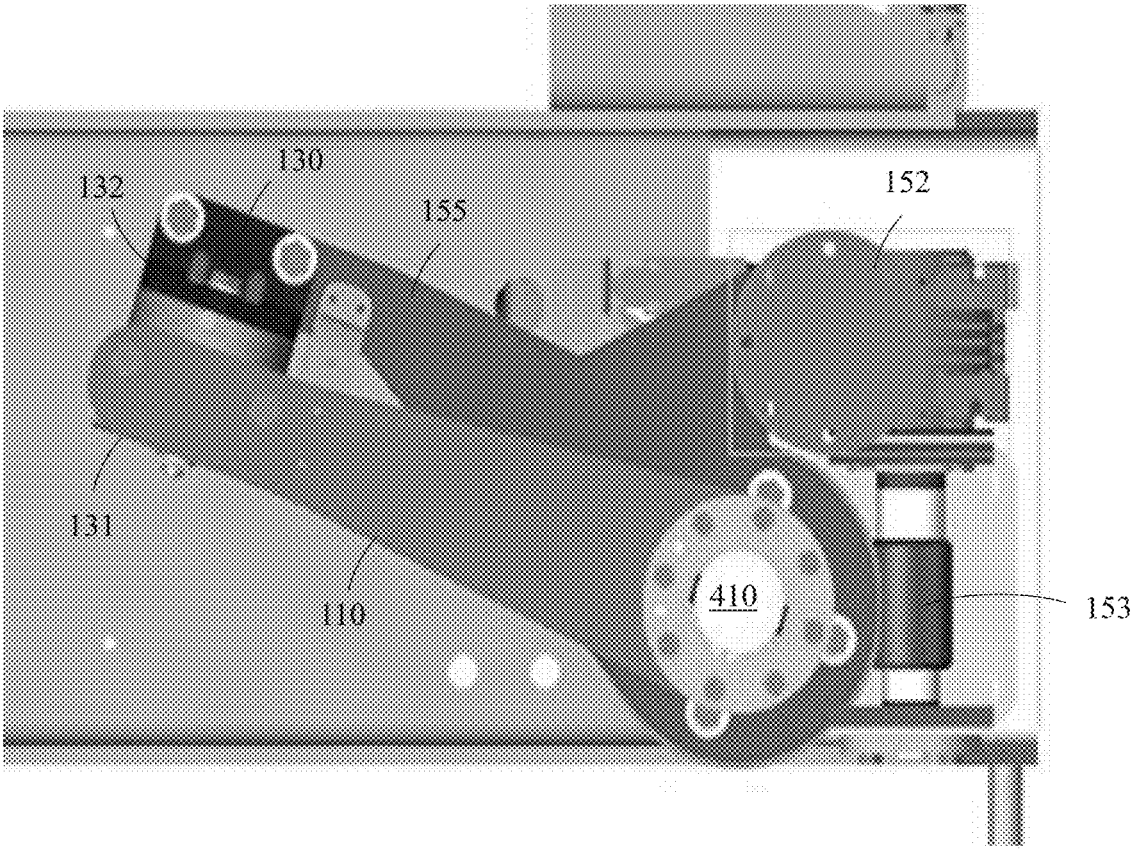
Figure 13:
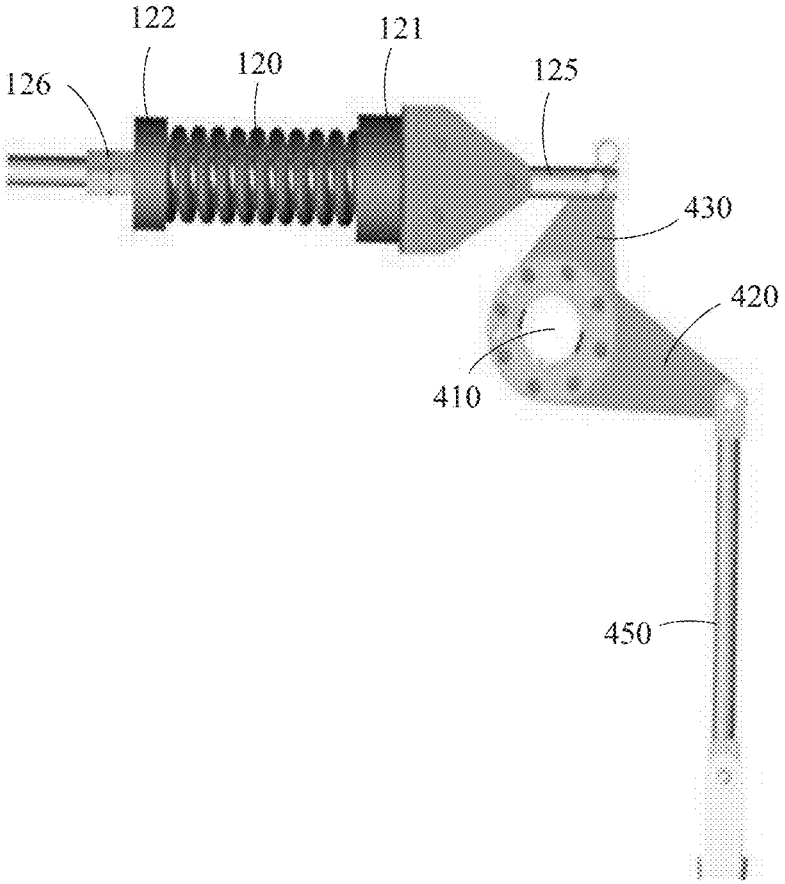

The invention will in the following be described in greater detail by means of preferred embodiments with reference to the attached drawings, in which FIG. 1 shows a side view of an elevator, FIG. 2 shows a prior art safety gear arrangement in an elevator, FIG. 3 shows a first cross sectional view of a safety gear, FIG. 4 shows a further cross sectional view of the safety gear, FIG. 5 shows a cross sectional view of a first embodiment of a safety gear trigger and reset system according to the invention, FIG. 6 shows a cross sectional view of a second safety gear synchronisation system, FIG. 7 shows an axonometric view of the first embodiment of the safety gear trigger and reset system mounted to an elevator, FIG. 8 shows a cross sectional view of a first safety gear synchronisation system, FIG. 9 shows an axonometric view of a second embodiment of a safety gear trigger and reset system mounted to an elevator, FIG. 10 shows an axonometric view of a third embodiment of a safety gear trigger and reset system, FIG. 11 shows on upper view of the third embodiment of the safety gear trigger and reset system, FIG. 12 shows a side view of an actuator of the third embodiment of the safety gear trigger and reset system, FIG. 13 shows a side view of a spring means of the third embodiment of the safety gear trigger and reset system.

DETAILED DESCRIPTION

FIG. 1 shows a side view of a prior art elevator.

The elevator may comprise a car 10, an elevator shaft 20, hoisting machinery 30, ropes 42, and a counterweight 41. A separate or an integrated car frame 11 may surround the car 10.

The hoisting machinery 30 may be positioned in the shaft 20. The hoisting machinery may comprise a drive 31, an electric motor 32, a traction sheave 33, and a machinery brake 34. The hoisting machinery 30 may move the car 10 in a vertical direction Z upwards and downwards in the vertically extending elevator shaft 20. The machinery brake 34 may stop the rotation of the traction sheave 33 and thereby the movement of the elevator car 10.

The car frame 11 may be connected by the ropes 42 via the traction sheave 33 to the counterweight 41. The car frame 11 may further be supported with gliding means 27 at guide rails 25 extending in the vertical direction in the shaft 20. The gliding means 27 may comprise rolls rolling on the guide rails 25 or gliding shoes gliding on the guide rails 25 when the car 10 is moving upwards and downwards in the elevator shaft 20. The guide rails 25 may be attached with fastening brackets 26 to the side wall structures 21 in the elevator shaft 20. The gliding means 27 keep the car 10 in position in the horizontal plane when the car 10 moves upwards and downwards in the elevator shaft 20. The counterweight 41 may be supported in a corresponding way on guide rails that are attached to the wall structure 21 of the shaft 20.

The car 10 may transport people and/or goods between the landings in the building. The elevator shaft 20 may be formed so that the wall structure 21 is formed of solid walls or so that the wall structure 21 is formed of an open steel structure.

The figure shows further a prior art speed limiter system based on a mechanical pulley and a rope system. The system comprises a speed limiter pulley 52 mounted e.g. in the upper part of the elevator shaft 20, a tensioning pulley 53 mounted in the lower part of the elevator shaft 20 and a speed limiter rope 51 fitted to run in a substantially tight closed loop around these pulleys 52, 53. A mechanical linkage system may connect the speed limiter rope 51 to the safety gears 70, 80. The speed limiter rope 51 runs around the speed limiter pulley 52 and the tensioning pulley 53 when the car 10 is moving. If the elevator car 10 and thereby also the speed limiter rope 51 move at an excessive speed, then the rotation of the speed limiter pulley 52 in the upper part of the elevator shaft 20 is stopped by a mechanism activated e.g. by centrifugal force and at the same time the speed limiter rope 51 also stops moving. The stationary speed limiter rope 51 will exert a pull on the mechanical linkage system, causing the safety gears 70, 80 to grip the guide rails 25 guiding the elevator car 10 and thereby stop the car 10.

FIG. 2 shows a prior art safety gear arrangement in an elevator.

The safety gear arrangement comprises a mechanical linkage system 60 supported on the car frame 11. The car 10 moves upwards and downwards in the shaft supported on the guide rails 25. The car frame 11 surrounds the car 10 and may comprise upper horizontal pair of beams 11A or top beams, lower horizontal pair of beams 11B or bottom beams, and two vertical beam pairs 11C, 11D positioned on either side of the car 10. The mechanical linkage system 60 may comprise a pair of first linkage parts 61A, 61B positioned on opposite sides of the car 10 above the car 10. Each of the first linkage parts 61A, 61B may be connected with an articulated joint J1, J2 to a horizontal beam of the car frame 11. The first linkage parts 61A, 61B may be connected with a crosswise running pull bar 62 to each other. Outer ends of the first linkage parts 61A, 61B may further be connected with vertical pull bars 63A, 63B to a respective safety gear 70, 80.

An outer end of the first linkage part 61A is further connected with an articulated joint J3 to the speed limiter rope 51. There is a safety gear 70, 80 at each side of the car 10. The safety gears 70, 80 may be supported on the car frame 11 below the car 10 or above the car 10 and they may act on the guide rails. The safety gears 70, 80 may grip the guide rail 25 when they are activated, whereby the car 10 stops. The safety gears 70, 80 may be identical.

The function of the safety gear arrangement will be described in the following.

Overspeeding of the car 10 activates the speed governor 52, whereby the rotation of the speed governor 52 is stopped and also the speed limiter rope 51 is stopped. The stopped speed limiter rope 51 exerts a pull on the linkage system 60 at the elevator car 10 that is still moving, whereby the outer end of the first linkage part 61A on the left hand side in the figure is turned upwards around the articulated joint J1. The crosswise running pull bar 62 thus turns the outer end of the first linkage part 61B on the right hand side in the figure also upwards around the articulated joint J2. As a result of this, the vertical pull rods 63A, 63B will be pulled upwards, whereby both safety gears 70, 80 are activated.

FIG. 3 shows a first cross sectional view of a safety gear and FIG. 4 shows a further cross sectional view of the safety gear.

The safety gear 70, 80 shown in FIGS. 3 and 4 is just one example of a prior art safety gear 70, 80 that may be used in connection with the inventive safety gear trigger and reset system.

The safety gear 70, 80 may comprise a frame 74, a force element 73, a brake surface 71, and a support surface 72. The cross-section of the frame 74 may have a shape of a letter C, whereby a portion of the guide rail 25 protrudes into the opening in the letter C. The brake surface 71 is at a distance from a first side surface of the guide portion 25A of the guide rail 25 and the support surface 72 is at a distance from an opposite, second side surface of the guide portion 25A of the guide rail 25. The force element 73 may be a roll rotating on a shaft 76. An outer end of the shaft 76 may be supported on a shield 75 of the frame 74. The outer end of the shaft 76 may pass through an oblong guide opening in the shield 75. The oblong guide opening in the shield 75 has the same form as the support surface 72. The support surface 72 may form a straight inclined track as shown in FIG. 2 or the support surface 72 may have any other form. The support surface 72 may form one or several curved tracks or one or several curved tracks and straight tracks positioned after each other in any order as shown in FIG. 4. The curvature of the curved tracks may be the same or they may have a different curvature.

Referring to FIGS. 3 and 4, upon safety gear activation, the roll 73 is pressed in the figures to the left towards the side surface of the guide rail 25 when the shaft 76 of the roller 73 moves upwards in the guide opening in the shield 75. The form of the support surface 72 will determine the time it takes for the roller 73 to come into contact with the side surface of the guide rail 25 at a certain speed of the elevator car 10. Once the roller 73 comes into contact with the side surface of the guide rail 25 and is urged further by the support surface 72, the safety gear 70, 80 will be moved to the right so that the brake surface 71 comes into contact with the opposite side surface of the guide rail 25. The safety gear 70, 80 will thereby start braking with the brake surface 71. The roll 73 can still after this move a bit upwards whereby the braking force of the brake surface 71 is intensified. The rotation of the roll 73 will at the upper end of the support surface 72 be stopped, whereby the outer surface of the roll 73 forms a second brake surface against the side surface of the guide portion 25A of the guide rail 25.

The roller 73 in the safety gear 70, 80 may be connected to a respective vertical pull rod 63A, 63B. An upward movement of the vertical pull rod 63A, 63B results in an upward movement of the roller 73 along the support surface 72, whereby the safety gear 70, 80 starts to brake.

FIG. 5 shows a cross sectional view of a first embodiment of a safety gear trigger and reset system according to the invention.

The safety gear trigger and reset system 100 comprises a lever 110, spring means 120, an electromagnet 130, and an actuator 140.

The lever 110 may be formed of an elongated piece of flat iron comprising a first end 111 and a second opposite end 112. The first end 111 of the lever 110 may be attached to a first synchronization shaft 210. The first synchronization shaft 210 may comprise a longitudinal axis of rotation. The lever 110 may extend in a direction substantially perpendicular to the longitudinal direction of the first synchronization shaft 210. The lever 110 may comprise an opening 115 into which the first synchronization shaft 210 may be fitted. The cross section of at least the portion of the first synchronization shaft 210 that is fitted into the opening 115 in the lever 110 may be rectangular. The edges of the opening 115 in the lever 110 may be provided with flanges protruding outwards from the lever 110. The flanges provide further support surfaces for the first synchronization shaft 210. Also the cross section of the opening 115 in the lever 110 may thus be rectangular. Turning of the lever 110 rotates the first synchronization shaft 210 around its longitudinal axis of rotation. The first synchronization shaft 210 may be rotatably attached to the car frame 11. The first synchronization shaft 210 may be operatively connected to a first safety gear 70. The first synchronization shaft 210 may further be operatively connected to a second synchronization shaft 310, which is operatively connected to a second safety gear 80 on the opposite side of the car 10. Turning S1 of the first synchronization shaft 210 will activate or deactivate the first safety gear 70 and the second safety gear 80.

The electromagnet 130 may be operatively connected to the lever 110. The electromagnet 130 may comprise an armature 131 and a magnetic core 132 provided with an electric coil. The armature 131 may be supported on the lever 110. The armature 131 may be attached to the lever 110. The magnetic core 132 may be supported on the car frame 11. The magnetic core 132 may be attached to the car frame 11. The armature 131 may be provided with a flexible material 133 in order to decrease the noise from the electromagnet 130 making contact with the armature 131. The armature 131 and thereby also the lever 110 are thus magnetically connectable to the stationary magnetic core 132 attached to the car frame 11. The electromagnet 130 may be activated when an electric current flows in the electric coil i.e. the magnetic core 132 exerts a magnetic attraction force to the armature 131. The armature 131 becomes thus magnetically attached to the magnetic core 132 when the electromagnet 130 is activated. The electromagnet 130 is deactivated when the flow of the electric current in the electric coil is interrupted i.e. the magnetic attraction exerted by the magnetic core 132 is terminated. The armature 131 may thus be disconnected from the magnetic core 132 when the electromagnet 130 is deactivated.

The spring means 120 may be operatively connected to the lever 110. A first end of the spring means 120 may be supported in a first bushing 121. The first bushing 121 may be attached to the car frame 11. A second end of the spring means 120 may be supported in a second bushing 122. The second bushing 122 may be attached to the lever 110. The spring means 120 may extend between a middle portion 113 of the lever 110 and the car frame 11.

A resetting means in the form of an actuator 140 may be operatively connected to the synchronization shaft 210 via the lever 110. The actuator 140 may be a linear actuator. The actuator 140 may comprise a cylinder 141 or a motor and a piston rod 142. A longitudinal connection rod 143 may be attached to an outer end of the piston 142. The connection rod 143 may be provided with a longitudinal slot 144. The slot 144 may extend substantially in a vertical direction. A pin 116 forming an articulated joint J11 may be attached to the lever 110. The pin 116 may extend in a transverse direction in relation to a longitudinal direction of the lever 110. The pin 116 may protrude into the slot 144 in the connection rod 143. The pin 116 may thus slide freely S2 in the slot 144 allowing the lever 110 to move freely downwards from the first position to the second position. The slot 144 may be open or closed at a first end of the connection rod 143, closer to the lever 110. The slot 144 may on the other hand be closed at the second end of the connection rod 143. The second closed end of the slot 144 forms a shoulder for the pin 116. The cylinder 141 may be attached the car frame 11.

The spring means 120 and the electromagnet 130 may be positioned on the same side of the lever 110 and the actuator 140 may be positioned on the opposite side of the lever 110. The spring means 120 may be formed of a coil spring. The actuator 140 could also be positioned on the same side of the lever 110 as the spring means 120. The lever 110 would then be returned to the first position by pulling with the connection rod 143 when the piston rod 142 retracts. The distance between the pin 116 and the synchronization shaft 210 and the angle between the lever 110 and the actuator 140 determine the power that is needed from the actuator 140 in order to return the lever 110 to the first position against the force of the spring means 120.

The electromagnet 130 may be controlled by a control unit 180 i.e. the control unit 180 may activate and deactivate the electromagnet 130. A speed detector 190 may be used to measure the speed of the car 10. An output of the speed detector 190 may be connected to the control unit 180. A predefined speed limit may be set for the speed of the car 10. The control unit 180 compares the measured speed of the car 10 with the predefined speed limit of the car 10 and deactivates the electromagnet 130 i.e. cuts the current to the electromagnet 130 in case the predefined speed limit is exceeded.

The safety gear trigger operates in the following way:

The controller 180 keeps the electromagnet 130 in an activated state i.e. current is flowing through the coil in the electromagnet 130 when the elevator is operated in a normal state. The lever 110 is thus magnetically connected to the electromagnet 130 and the first synchronization shaft 210 is in the position shown in the figure. This means that the spring 120 is in a compressed state i.e. in an excited state. The lever 110 and thereby also the first synchronization shaft 210 is shown in a first position in the figures. The safety gears 70, 80 are deactivated in this first position.

Deactivation of the electromagnet 130 i.e. disconnection of the current flowing through the coil in the electromagnet 130 will release the lever 110 from the contact with the electromagnet 130. The spring 120 will thereby expand and press the lever 110 downwards in FIG. 5. The spring means 120 produces a downward directed stroke to the lever 110. This means that the first synchronization shaft 210 will be rotated S1 in a counter-clockwise direction. The counter-clockwise rotation of the first synchronization shaft 210 will in turn activate the safety gears 70, 80, whereby the car 10 is stopped. The lever 110 and thereby also the first synchronization shaft 210 are thus in a second position in which the safety gears 70, 80 are activated.

The safety gear trigger 100 may be reset by turning the lever 110 back to the initial first position with the actuator 140. The second end 112 of the lever 110 has moved downwards i.e. the pin 116 has moved downwards in the slot 144 in the connection rod 143 by the force exerted by the spring 120. Activation of the actuator 140 moves the piston 142 outwards i.e. upwards in FIG. 5 from the cylinder 141. The lower edge of the slot 144 forms a shoulder for the pin 116, whereby the pin 116 and thereby also the second end 112 of the lever 110 is pushed upwards back into contact with the electromagnet 130. The spring 120 is again pressed together to be in an excited state. The first synchronization shaft 210 is at the same time rotated S1 in a clockwise direction, whereby the safety gears 70, 80 can be released by moving the car 10 in the shaft 20 to a direction opposite to that into which the car 10 was moving upon safety gear activation. The electromagnet 130 is activated so that the lever 110 becomes magnetically attached to the electromagnet 130. The piston 142 may then be lowered again into the cylinder 141 so that the pin 116 may glide downwards in the slot 144 when the electromagnet 130 is again deactivated.

FIG. 6 shows a cross sectional view of a first safety gear synchronisation system.

The first safety gear synchronization system comprises two synchronisation shafts 210, 310 positioned on opposite sides of the car 10. The synchronisation shafts 210, 310 are parallel. The longitudinal centre axis of each synchronisation shaft 210, 310 extends in a direction perpendicular to the paper. Each synchronisation shaft 210, 310 may be rotatably attached to the car frame 11 (not shown in the figure). Each synchronisation shaft 210, 310 may further be operatively connected to a respective safety gear 70, 80. The cross section of each synchronization shaft 210, 310 may be rectangular. A swinging bracket 220, 320 may be connected to each synchronisation shaft 210, 310. The swinging bracket 220, 320 may be provided with an opening 215, 315 mating with the rectangular cross section of the respective synchronization shaft 210, 310. The swinging bracket 220, 320 may have a shape that provides leverage for a first pull bar 250 i.e. a transverse pull bar 250 connecting the two swinging brackets 220, 320 and thereby also the synchronisation shafts 210, 310 operatively together. The transverse pull bar 250 uses the leverage to rotate the synchronization shafts 210, 310. The transverse pull bar 250 may be provided with an adjustment piece 255 making it possible to easily adjust the length of the transverse pull bar 250. Adjustment of the length of the transverse pull bar 250 may be needed in order to be able to adjust the triggering of the safety gears 70, 80. A first end of the transverse pull bar 250 may be attached with a first articulated joint J21 to the first swinging bracket 220. A second end of the transverse pull bar 250 may be attached with a second articulated joint J31 to the second swinging bracket 320.

The operative connection between the first swinging bracket 220 and the first safety gear 70 may be realized with a first vertical pull bar 77. One end of the first vertical pull bar 77 may be attached to the first safety gear 70 and the other opposite end of the first vertical pull bar 77 may be attached via an articulated joint J22 to the first swinging bracket 220. The operative connection between the second swinging bracket 320 and the second safety gear 80 may be realized with a second vertical pull bar 87. One end of the second vertical pull bar 87 may be attached to the second safety brake 80 and the other opposite end of the second vertical pull bar 87 may be attached via an articulated joint J32 to the second swinging bracket 320. An upward S3 movement of the first vertical pull bar 77 activates the first safety gear 70. An upward S4 movement of the second vertical pull bar 87 activates the second safety gear 80.

The lever 110 shown in FIG. 5 may be connected to the first synchronization shaft 210 at an axial distance from the first swinging bracket 220 or it may be a part of the first swinging bracket 220. The lever 110 and the equipment associated with the lever 110 may be positioned outside the pair of horizontal beams forming the top beam 11A of the car frame 11 and/or the pair of horizontal beams forming the bottom beam 11B of the car frame 11. The safety gear synchronisation system may be positioned inside the pair of horizontal beams forming the top beam 11A of the car frame 11 and/or the pair of horizontal beams forming the bottom beam 11B of the car frame 11. The synchronization shafts 210, 310 may pass through the respective pair of horizontal beams 11A, 11B of the car frame 11. The synchronization shafts 210, 310 may be rotatably supported on the respective pair of horizontal beams of the car frame 11. Rotation of the first synchronization shaft 210 with the lever 110 in a counter-clockwise direction will rotate the second synchronization shaft 310 in a clockwise direction. Both vertical pull bars 77, 87 will thus be pulled upwards, whereby both safety gears 70, 80 become activated. Rotation of the first synchronization shaft 210 with the lever 110 in a clockwise direction will rotate the second synchronization shaft 310 in a counter-clockwise direction. Both vertical pull bars 77, 87 will thus be pushed downwards, whereby both safety gears 70, 80 become deactivated. The safety gears 70, 80 will then release their grip on the guide rails 25 when the elevator car 10 is moved in the shaft 20 in a direction that is opposite to the direction in which the car 10 was moving upon safety gear activation.

The operation of the safety gear trigger and reset system according to FIG. 6 is as follows:

Overspeeding of the car 10 results in that the controller 180 deactivates the electromagnet 130, whereby the lever 110 is released from the contact with the electromagnet 130. The spring means 120 is thus released, which means that the spring means 120 will expand i.e. the lever 110 will be pushed downwards. The first synchronisation shaft 210 and thereby also the first swinging bracket 220 will thus be turned in a counter clockwise direction. The first vertical pull bar 77 will move upwards, whereby the first safety gear 70 is activated. Simultaneously, the transverse pull bar 250 will pull the second swinging bracket 320 so that the second synchronisation shaft 310 rotates in a clockwise direction. The second vertical pull bar 87 will thus move upwards, whereby the second safety gear 80 is activated.

The safety gears 70, 80 may be deactivated again by pushing the lever 110 upwards with the actuator 140 and by activating the electromagnet 130 so that the lever 110 becomes again electromagnetically attached to the electromagnet 130.

FIG. 7 shows a cross sectional view of a second safety gear synchronisation system.

This second safety gear synchronisation system is a modification of the first safety gear synchronisation system. The spring means 120 of the first safety gear trigger and reset system has been moved from the operative connection with the lever 110 to an operative connection with the transverse pull bar 250. The spring means 120 is operatively connected to the transverse pull bar 250 and via the transverse pull bar 250 to the first synchronization shaft 210 and to the second synchronisation shaft 310. The spring means 120 extends between the transverse pull bar 250 and the car frame 11. The first end of the spring means 120 may be supported in a first bushing 121 and the second end of the spring means 120 may be supported in a second bushing 122. The first bushing 121 may be attached to the car frame 11. The first bushing 121 is thus stationary in relation to the car frame 11. The second bushing 122 may be attached to the transverse pull bar 250. The second bushing 122 moves with the transverse pull bar 250.

The first pull bar 250 i.e. the transverse pull bar 250 may be formed as a single pull bar or as two transverse pull bar portions 251, 252. A first portion 251 of the transverse pull bar 250 may be provided with an adjustment piece 255 making it possible to easily adjust the length of the transverse pull bar 250. Adjustment of the length of the transverse pull bar 250 may be needed in order to be able to adjust the triggering of the safety gears 70, 80. The first portion 251 of the transverse pull bar 250 may extend from the first articulated joint J21 on the first swinging bracket 220 to the second bushing 122. The second portion 252 of the transverse pull bar 250 may extend from the second articulated joint J31 on the second swinging bracket 320 through or past the first bushing 271 and the spring means 120 to the second bushing 272. The first bushing 271 is attached to the car frame 11. The first bushing 271 is stationary in relation to the car frame 11. The second bushing 272 is attached to the transverse pull bar 250. The second bushing 122 moves with the transverse bull bar 250 as shown by the two-headed arrow S5.

The lever 110 shown in FIG. 5 may be connected to the first synchronization shaft 210 at an axial distance from the first swinging bracket 220 or it may be a part of the first swinging bracket 220. The lever 110 and the equipment associated with the lever 110 may be positioned in connection with the pair of beams forming the horizontal top beam 11A and/or the horizontal bottom beam 11B of the car frame 11. The safety gear synchronisation system may also be positioned in connection with the pair of beams forming the horizontal top beam 11A and/or the horizontal bottom beam 11B of the car frame 11. The synchronization shafts 210, 310 may be rotatably attached to the car frame 11. Rotation of the first synchronization shaft 210 with the lever 110 in a counter-clockwise direction will pull both vertical pull bars 77, 87 upwards, whereby both safety gears 70, 80 become activated. Rotation of the first synchronization shaft 210 with the lever 110 in a clockwise direction will push both vertical pull bars 77, 87 downwards, whereby both safety gears 70, 80 become deactivated.

The spring means 120 is in the figure positioned on the pull bar 250 so that the pull bar 250 passes through the spring means 120. This is an advantageous embodiment. The spring means 120 could, however, also be positioned on the side of the pull bar 250, whereby the first bushing 271 could be provided with a protrusion being attached to the pull bar 250. The spring means 120 would thus be positioned in connection with the pull bar 250.

The operation of the safety gear trigger and reset system according to FIG. 7 is as follows:

Overspeeding of the car 10 results in that the controller 180 deactivates the electromagnet 130, whereby the lever 110 is released from the contact with the electromagnet 130. The spring means 120 is thus released, which means that the spring means 120 will expand i.e. the second bushing 122 will move S5 farther away from the first fixed bushing 121. The second bushing 122 will thus push the first portion 251 of the transverse pull bar 250 so that the first synchronisation shaft 210 turns in an counter clockwise direction. The first vertical pull bar 77 will move upwards, whereby the first safety gear 70 is activated. The second bushing 122 will at the same time pull the second portion 252 of the transverse pull bar 250 so that the second synchronisation shaft 310 rotates in a clockwise direction. The second vertical pull bar 87 will move upwards, whereby the second safety gear 80 is activated.

The safety gears 70, 80 may be deactivated again by pushing the lever 110 upwards with the actuator 140 and by activating the electromagnet 130 so that the lever 110 becomes again electromagnetically attached to the electromagnet 130.

FIG. 8 shows an axonometric view of the first embodiment of the safety gear trigger and reset system mounted to an elevator.

The safety gear trigger and reset system 100 comprising the lever 110, the spring means 120, the electromagnet 130, and the actuator 140 are positioned outside the pair of beams forming the horizontal bottom beam 11B of the car frame 11. The first synchronization shaft 210 passes through the pair of beams forming the horizontal bottom beam 11B of the car frame 11. The first synchronization shaft 210 is rotatably supported on the pair of beams forming the bottom beam 11B of the car frame 11.

A safety gear synchronisation system based on a pull rod system as e.g. shown in FIG. 6 may be provided on the opposite side of the pair of beams forming the bottom beam 11B or between the pair of beams forming the bottom beam 11B. The pull rod system may connect the first synchronization shaft 210 and the second synchronisation shaft 310 together. Each safety gear 70, 80 may further be operatively connected to a respective synchronisation shaft 210, 310. The upper end of the electromagnet 130 and the upper end of the spring means 120 are attached with a respective support flange to the outer side of the bottom beam 11B in the car frame 11. The actuator 140 may also be supported via a support flange on the bottom beam 11B of the car frame 11.

FIG. 9 shows an axonometric view of a second embodiment of a safety gear trigger and reset system mounted to an elevator.

This embodiment corresponds to the safety gear synchronization system shown in FIG. 7.

The safety gear trigger comprising the lever 110, the spring means 120, the electromagnet 130, and the actuator 140 are positioned between the pair of beams forming the horizontal top beam 11A of the car frame 11. The two synchronization shafts 210, 310 are positioned on opposite sides of the car 10. The two synchronization shafts 210, 310 pass through the pair of beams forming the horizontal top beam 11A of the car frame 11. The first synchronization shaft 210 and the second synchronization shaft 310 are rotatably supported on the pair of beams forming the horizontal top beam 11A of the car frame 11. The upper end of the electromagnet 130 and the actuator 140 are attached with a respective support flange to the side of the top beam 11A of the car frame 11 (the second top beam of the pair of top beams is not show in the figure).

A first swinging bracket 220 is attached to the first synchronization shaft 210 and a second swinging bracket 320 is attached to the second synchronization shaft 310. A first pull bar 250 forming a transverse pull bar 250 extends between the swinging brackets 220, 320. The transverse pull bar 250 is formed of two portions 251, 252. The synchronization shafts 210, 310 are thus operatively connected to each other with the transverse pull bar 250.

The first end of the spring means 120 is supported in a first bushing 121 and the second end of the spring means 120 is supported in a second bushing 122. The first bushing 121 is attached to the top beam 11A of the car frame 11. The first bushing 121 is stationary in relation to the car frame 11. The second bushing 122 is attached to the transverse pull bar 250. The second bushing 122 moves with the transverse pull bar 250. The first portion 251 of the transverse pull bar 250 extends between the first swinging bracket 220 and the second bushing 122. The length of the first portion 251 of the transverse pull bar 250 may be adjusted with an adjustment piece 255. The second portion 252 of the transverse pull bar 250 extends between the second swinging bracket 320 and the second bushing 122. The second portion 252 of the transverse pull bar 250 passes thus through the first bushing 121 and through the spring means 120.

The lever 110 is connected to the first synchronization shaft 210 at an axial distance from the first swinging bracket 220. The lever 110 may be positioned outside the second beam (not shown in the figure) of the horizontal top beams 11A. The electromagnet 130 and the actuator 140 are operatively connected to the lever 110. Release of the electromagnet 130 will result in rotation of the first synchronization shaft 210 in a counter-clockwise direction, whereby the second synchronization shaft 310 rotates in the clockwise direction. Both vertical pull bars 77, 87 will thus be pulled upwards, whereby both safety gears 70, 80 become activated. Rotation of the first synchronization shaft 210 with the actuator 140 acting on the lever 110 in a clockwise direction will rotate the second synchronization shaft 310 in a counter-clockwise direction. Both vertical pull bars 77, 87 will be pushed downwards, whereby both safety gears 70, 80 become deactivated. The lever 110 could naturally instead of being connected to the first synchronization shaft 210 be connected to the second synchronization shaft 310.

The spring means 120 acts on the first synchronization shaft 210 in a first action point P1 and the resetting means 140 acts on the first synchronization shaft 210 in a second action point P2, the first action point P1 being at an axial distance from the second action point P2.

FIG. 10 shows an axonometric view and FIG. 11 shows on upper view of a third embodiment of the safety gear trigger and reset system. FIG. 12 shows a side view of an actuator and FIG. 13 shows a side view of a spring means of the third embodiment of the safety gear trigger and reset system.

The safety gear trigger and reset system in this embodiment comprises three synchronization shafts 210, 310, 410. The first synchronization shaft 210 and the second synchronization shaft 310 are positioned below the car 10 at opposite sides of the car 10. The first synchronization shaft 210 and the second synchronization shaft 310 are rotatably supported on opposite ends of the pair of beams forming the horizontal bottom beam 11B of the car frame 11. The third synchronization shaft 410 is positioned above the car 10. The third synchronization shaft 410 passes through the pair of beams forming the horizontal top beam 11A of the car frame 11. The third synchronization shaft 410 is rotatably supported on the pair of beams forming the horizontal top beam 11A of the car frame 11.

Two axially displaced swinging brackets 220, 230 are attached to the first synchronization shaft 210 and two axially displaced swinging brackets 320, 330 are attached to the second synchronization shaft 310. The swinging brackets 220, 230 on the first synchronization shaft 210 are connected with vertical pull bars 77 to the first safety gear 70 and the swinging brackets 320, 330 on the second synchronization shaft 310 are connected with vertical pull bars 87 to the second safety gear 80. The first synchronization shaft 210 is operatively connected to the second synchronization shaft 310 with a transverse pull bar 250. The first pull bar 250 i.e. the transverse pull bar 250 extends between one of the swinging brackets 220, 230 on the first synchronization shaft 210 and one of the swinging brackets 320, 330 on the second synchronization shaft 310. The length of the transverse pull bar 250 may be adjusted with an adjustment piece 255.

The safety gear trigger comprising the spring means 120, the lever 110, the electromagnet 130 and the actuator 150 are positioned above the car 10 in connection with the third synchronization shaft 410. The spring means 120 are positioned on a first side of the two beams forming the horizontal top beam 11A of the car frame 11. The lever 110, the electromagnet 130 and the actuator 150 of the safety gear trigger are positioned on a second opposite side of the pair of beams forming the horizontal top beam 11A of the car frame 11. The spring means 120 acts on the third synchronization shaft 410 in a first action point P1 and the resetting means 150 acts on the third synchronization shaft 410 in a second action point P2, the first action point P1 being at an axial distance from the second action point P2.

Two axially displaced swinging brackets 420, 430 are attached to the third synchronization shaft 410. The first synchronization shaft 210 and the third synchronization shaft 410 are operatively connected with a second pull bar 450 i.e. a vertical pull bar 450 extending between a swinging bracket 230 on the first synchronization shaft 210 and a swinging bracket 420 on the third synchronization shaft 310. The vertical pull bar 450 is attached with respective articulated joints J23, J41 to the respective swinging brackets 230, 420. The swinging bracket 420 on the third synchronization shaft 410 may be positioned between the pair of beams forming the horizontal top beam 11A of the car frame 11.

The spring means 120 is operatively connected to the third synchronization shaft 410. A first end of the spring means 120 is supported in a first bushing 121 and the second end of the spring means 120 is supported in a second bushing 122. The first bushing 121 is attached to the top beam 11A of the car frame 11. The first bushing 121 is stationary in relation to the car frame 11. The second bushing 122 is movable with the spring means 120. A pull bar 125 passes through the spring means 120, the first bushing 121 and the second bushing 122. A first end of the pull bar 125 is attached with an articulated joint J42 to a swinging bracket 430 attached to the third synchronization shaft 410. A second opposite end of the pull bar 125 is attached to the second bushing 122. At least a portion of the pull bar 125 may be provided with a threading. The second bushing 122 may be attached to the pull bar 125 with a nut 126 mating with the threading on the pull bar 125. The tension of the spring means 120 between the first bushing 121 and the second bushing 122 may thus be adjusted by rotating the nut 126 on the threading on the pull bar 125.

A first end of the lever 110 is attached to the third synchronization shaft 410 at an axial outer end of the third synchronization shaft 410. The lever 110 may comprise two parallel lever arms running at a distance from each other. The lever 110 is fixedly connected to the third synchronization shaft 410.

The actuator 150 for resetting the safety gear trigger 100 comprises an electric motor 151, an angle transmission 152, a worm gear 153 and an actuator arm 155. The actuator 150 is based on a rotating movement in this embodiment. The actuator arm 155 may comprise two parallel actuator arms running at a distance from each other. The shaft of the electric motor 151 is connected to the angle transmission 152 and the angle transmission 152 is connected to the worm screw of the worm gear 153. The electric motor 151 may thus rotate the worm wheel of the worm gear 153 via the angle transmission 152.

The first end of the actuator arm 155 is fixedly connected to the worm wheel of the worm gear 153. The worm wheel of the worm gear 153 is rotatably supported by the third synchronization shaft 410. Rotation of the worm wheel will then turn (rotate) the actuator arm 155 around the third synchronization shaft 410. The worm gear 153 can be rotated in opposite directions with the electric motor 151 by changing the direction of rotation of the electric motor 151. The actuator arm 155 is connected via the worm gear 153 to the angle transmission 152.

The electromagnet 130 extends between the second outer ends of the lever 110 and the actuator arm 155. The armature 131 of the electromagnet 130 may be attached to the outer end of the lever 110 and the magnetic core 132 of the electromagnet 130 may be attached to the outer end of the actuator arm 155. Activation of the electromagnet 130 keeps the lever 110 connected to the actuator arm 155. Deactivation of the electromagnet 130 opens the connection between the lever 110 and the actuator arm 155. The magnetic core 132 of the electromagnet 130 is thus supported to the car frame 11 via the actuator arm 155, the worm gear 153 and the angle transmission 152. The armature 131 of the electromagnet 130 is supported on the lever 110. The electromagnet 130 is operatively connected to the lever 110.

Disconnection of the electromagnet 130 will open the connection between the lever 110 and the actuator arm 155. This results in that the spring means 120 pushes the swinging bracket 430 so that the third synchronization shaft 410 rotates in a counter-clockwise direction. The first synchronization shaft 210 will thus also rotate in a counter-clockwise rotation and the second synchronization shaft 310 will rotate in a clockwise direction. Both vertical pull bars 77, 87 will be pulled upwards, whereby both safety gears 70, 80 become activated. The lever 110 will rotate with the third synchronization shaft 410 in a counter-clockwise direction (downwards) out of contact from the electromagnet 130 on the actuator arm 155.

The actuator arm 155 can be rotated in a counter-clockwise direction with the electric motor 151 so that the magnetic core 132 of the electromagnet 130 again comes into contact with the armature 131 on the lever 110. The electromagnet 130 can then be activated so that the actuator arm 155 and the lever 110 become connected to each other. The electric motor 151 can then be operated in an opposite direction, whereby the worm gear 153 rotates in an opposite direction resulting in that the actuator arm 155 is rotated in a clockwise direction (upwards). The lever 110 is attached with the electromagnet 130 to the actuator arm 155, whereby also the lever 110 will be rotated in the clockwise direction with the actuator arm 155. Rotation of the lever 110 in the clockwise direction will also rotate the third synchronization shaft 410 in the clockwise direction. The spring means 120 will thus again be compressed between the bushings 121, 122 i.e. the spring means 120 will be brought to an excited state. The spring means 120 becomes thus ready for a new strike. The rotation of the third synchronization shaft 410 in the clockwise direction will also push both vertical pull bars 77, 87 downwards, whereby both safety gears 70, 80 become deactivated. When not operating, the electric motor 151, the angle transmission 152 and the worm gear 153 constitute together a self-locking system that keeps the lever 110 in the upper position until the electromagnet 130 is deactivated again.

A first safety switch may be used to indicate that the actuator arm 155 is in the upper position and a second safety switch may be used to indicate that the lever 110 is attached to the actuator arm 155. The safety gear trigger may be considered to be reset when both safety switches are closed.

The safety gear trigger and reset system according to the invention eliminates the prior art speed limiter rope 51 with the pulleys 52, 53 as well as the linkage system 60.

The inventive safety gear trigger and reset system may advantageously be used in modernisations of elevators. The speed limiter rope 51, the pulleys 52, 53 associated with the speed limiter rope 51 and the linkage system 60 connecting the speed limiter rope 51 to the safety gears 70, 80 may be removed from an existing elevator and replaced with the inventive safety gear trigger and reset system. The lever 110 may be connected to an existing synchronization shaft 210, 220 in the elevator or a new synchronization shaft 410 may be arranged in the elevator. An existing speed detector 190 and an existing control unit 180 in the elevator may be used to control the inventive safety gear trigger and reset system.

The inventive safety gear trigger and reset system may be fitted in a limited space in connection with the pair of beams forming the horizontal top beam 11A and/or in connection with the pair of beams forming the horizontal bottom beam 11B of the car frame 11 in an existing elevator. The components of the safety gear trigger and reset system may be fitted on the outer side and/or on the inner side and/or between the pair of beams forming the top beam 11A of the car frame 11 in an existing elevator. The components of the safety gear trigger and reset system may on the other hand be fitted on the inner and/or on the outer side of the pair of beams forming the bottom beam 11B of the car frame 11 in an existing elevator. The components of the safety gear trigger and reset system may still further be distributed between the pair of beams forming the horizontal top beam 11A and/or the pair of beams forming the horizontal bottom beam 11B in any desired way.

The safety gear trigger and reset system may be used in connection with any kind of speed detector 190. The speed detector 190 may be based on electronical devices e.g. it may be based on one or more acceleration sensors or it may be based on encoder data. The encoder may be used to measure the rotation speed of the electric motor 32 driving the traction sheave 33. The speed detector 190 may on the other hand be based on mechanical devices e.g. a roller acting on the car guide rail 25.

The safety gear trigger and reset system may be used in connection with any kind of safety gear 70, 80, also in connection with a two-way safety gear that enables gripping for both downwards and upwards travel. The safety gear 70, 80 may be provided only in connection with one guide rail 25 or in connection with both guide rails or there may be more than one safety gear on each guide rail 25. The use of the safety gear trigger and reset system is thus not limited to the safety gear 70, 80 shown in the figures.

The first synchronizing shaft 210 and the second synchronization shaft 310 may each be operatively connected to at least one safety gear 70, 80. The operative connection is realized with vertical pull bars 77, 87 in the figures. The operative connection could, however, be realized in any suitable way e.g. with chains and/or with cog wheels and/or with transmission gears and/or with other force transmitting equipment so that rotation of the synchronizing shafts 210, 310 causes the corresponding safety gears 70, 80 to connect the brake and start braking or to disconnect the brake. The same applies to the operative connection between the first synchronization shaft 210 and the third synchronization shaft 410.

The first synchronization shaft 210 and the second synchronization shaft 310 are in the figures operatively connected to each other with a transverse pull bar 250. The transverse pull bar 250 may be formed of one or several interconnected pull bars. The first synchronization shaft 210 and the second synchronization shaft 310 are arranged to rotate in opposite directions in this solution. The operative connection could, however, be realized e.g. with a cogwheel on each of the synchronization shafts 210, 310 and a chain running over the cogwheels. The synchronization shafts 210, 310 would in such case rotate in the same direction. This would have to be taken into account in the connection to the safety gears 70, 80. The same applies to the operative connection between the first synchronization shaft 210 and the third synchronization shaft 410.

The safety gear trigger and reset system is, in the figures, positioned in connection with the car frame 11. The safety gear trigger and reset system may be positioned in connection with the pair of beams forming the horizontal top beam 11A and/or in connection with the pair of beams forming the horizontal bottom beam 11B of the car frame 11. These are advantageous positions for the components of the safety gear trigger and reset system.

The lever 110 may be attached to one of the synchronization shafts 210, 310, 410 and the electromagnet 130 may be operatively connected to the lever 110. The spring means 120 could be positioned freely in any position between the car frame 11 and a moving part in the safety gear trigger and reset system. The spring means 120 may be operatively connected to one of the synchronisation shafts 210, 310, 410. The spring means 120 may act directly on a synchronization shaft 210, 310, 410 through a swinging bracket attached to the synchronization shaft 210, 310, 410. The spring means 120 may on the other hand act indirectly on the synchronization shafts 210, 310, 410 through a pull bar 250 connecting the synchronization shafts 210, 310, 410.

The mutual position of the spring means 120 and the electromagnet 130 on the lever 110 could be changed. The actuator 140 could be positioned anywhere in relation to the lever 110. The first end 111 of the lever 110 is in the figures attached to the synchronization shaft 210, 310, 410. This is an advantageous embodiment in view of a situation in which there is space on one side of the first synchronization shaft 210. Another possibility is to attach the lever 110 from the middle portion 113 of the lever 110 to the synchronization shaft 210, 310, 410. The spring means 120 and the electromagnet 130 could then be positioned on opposite sides of the synchronization shaft 210, 310, 410.

The actuator 140 is in the embodiment shown in FIG. 5 operatively connected via the lever 110 to the synchronisation shaft 210. The lever 110 is attached to the synchronization shaft 210. The actuator 150 is on the other hand in the embodiment shown in FIG. 10 operatively connected via the actuator arm 155, the electromagnet 130 and the lever 110 to the synchronization shaft 410. The actuator arm 155 is rotatably supported on the synchronization shaft 410 and the lever 110 is attached to the synchronization shaft 410. The electromagnet 130 connects the lever 110 to the actuator arm 155. The actuator 140, 150 could be operatively connected via any kind of power transmission means to the synchronization shaft 210, 310, 410. The actuator 140, 150 forms a resetting means that resets the safety gear trigger i.e. deactivates the safety gear 70, 80 and brings the spring means 120 back to an excited state. The lever 110 may be attached with a form locking to the synchronization shaft 210, 410. The lever 110 may on the other hand be attached fixedly to the synchronization shaft 210, 410.

The actuator 140, 150 may produce a linear movement or a rotating movement. The movement of the actuator 140, 150 is converted into a rotational movement of the synchronization shaft 210, 310, 410. An actuator based on a piston-cylinder may produce a linear movement. An actuator based on an electric motor may produce a rotating movement. The actuator could be hydraulically, pneumatically or electromechanically operated.

The use of the invention is not limited to the elevator disclosed in the figures. The invention can be used in any type of elevator e.g. an elevator comprising a machine room or lacking a machine room, an elevator comprising a counterweight or lacking a counterweight. The counterweight could be positioned on either side wall or on both side walls or on the back wall of the elevator shaft. The drive, the motor, the traction sheave, and the machine brake could be positioned in a machine room or somewhere in the elevator shaft. The car guide rails could be positioned on opposite side walls of the shaft or on a back wall of the shaft in a so called ruck-sack elevator.

It will be obvious to a person skilled in the art that, as the technology advances, the inventive concept can be implemented in various ways. The invention and its embodiments are not limited to the examples described above but may vary within the scope of the claims.

The invention claimed is:

1. An elevator safety gear trigger and reset system comprising a synchronization shaft rotatably supported on an elevator car frame, the synchronization shaft being operatively connected to at least one safety gear, a lever attached to the synchronization shaft, an electromagnet operatively connected to the lever, a spring operatively connected to the synchronization shaft, an actuator operatively connected to the synchronization shaft, whereby activation of the safety gear is achieved by deactivating the electromagnet so that the lever is released from the operative connection with the electromagnet allowing the spring to rotate the synchronization shaft around its longitudinal axis from a first position in which the safety gear is deactivated to a second position in which the safety gear is activated, and deactivation of the safety gear and resetting of the safety gear trigger is achieved by activating the actuator to rotate the synchronization shaft around its longitudinal axis from the second position in which the safety gear is activated to the first position in which the safety gear is deactivated, the spring being brought back to an excited state at the same time.

2. The elevator safety gear trigger and reset system according to claim 1, wherein the actuator is operatively connected to the synchronization shaft.

3. The elevator safety gear trigger and reset system according to claim 2, wherein the actuator is configured to produces a linear or a rotational movement which is converted into a rotational movement of the synchronization shaft in order to rotate the synchronization shaft back to the first position.

4. The elevator safety gear trigger and reset system according to claim 1, wherein the spring is configured to acts on the synchronization shaft in a first action point and the actuator is configured to acts on the synchronization shaft in a second action point, the first action point being at an axial distance from the second action point.

5. The elevator safety gear trigger and reset system according to claim 1, wherein the spring is operatively connected between the car frame and the lever.

6. The elevator safety gear trigger and reset system according to claim 1, wherein the electromagnet comprises an armature being supported on the lever.

7. An elevator comprising an elevator car surrounded by a car frame moving upwards and downwards on guide rails in an elevator shaft, at least one safety gear supported on the car frame and acting on the guide rail, wherein an elevator safety gear trigger and reset system according to claim 1 is arranged in connection with the car frame.

8. An elevator safety gear trigger and reset system comprising a synchronization shaft rotatably supported on an elevator car frame, the synchronization shaft being operatively connected to at least one safety gear, a lever attached to the synchronization shaft, an electromagnet operatively connected to the lever, a spring operatively connected to the synchronization shaft, an actuator operatively connected to the synchronization shaft, whereby activation of the safety gear is achieved by deactivating the electromagnet so that the lever is released from the operative connection with the electromagnet allowing the spring to rotate the synchronization shaft from a first position in which the safety gear is deactivated to a second position in which the safety gear is activated, and deactivation of the safety gear and resetting of the safety gear trigger is achieved by activating the actuator to rotate the synchronization shaft from the second position in which the safety gear is activated to the first position in which the safety gear is deactivated, the spring being brought back to the excited state at the same time, wherein the system further comprises a first synchronisation shaft rotatably supported on the car frame and operatively connected to a first safety gear and a second synchronization shaft rotatably supported on the car frame and operatively connected to a second safety gear, the first synchronization shaft and the second synchronization shaft being operatively connected to each other so that the first synchronization shaft and the second synchronization shaft rotate in synchronism.

9. The elevator safety gear trigger and reset system according to claim 8, wherein the lever is attached to the first synchronisation shaft or to the second synchronization shaft.

10. The elevator safety gear trigger and reset system according to claim 8, wherein the operative connection between the first synchronization shaft and the second synchronization shaft is realized with a first pull bar extending between the first synchronization shaft and the second synchronization shaft.

11. The elevator safety gear trigger and reset system according to claim 10, wherein the spring is operatively connected between the car frame and the first pull bar.

12. The elevator safety gear trigger and reset system according to claim 8, wherein the system further comprises a third synchronisation shaft rotatably supported on the car frame, the third synchronization shaft being operatively connected to the first synchronization shaft or to the second synchronization shaft so that the operatively connected synchronizations shafts rotate in synchronism.

13. The elevator safety gear trigger and reset system according to claim 12, wherein the operative connection between the operatively connected synchronization shafts is realized with a second pull bar extending between the operatively connected synchronization shafts.

14. The elevator safety gear trigger and reset system according to claim 12, wherein the lever is attached to the third synchronisation shaft.

15. The elevator safety gear trigger and reset system according to claim 12, wherein the spring is operatively connected between the car frame and the third synchronization shaft.

* * * * *